United States Patent [19]

Terrade et al.

[11] Patent Number: 4,645,129

[45] Date of Patent: Feb. 24, 1987

[54] ATOMIZING NOZZLE AND USE

[75] Inventors: Francois Terrade; Claude Laheyne, both of Bordeaux, France

[73] Assignee: Phillips Petroleum Company, Bartlesville, Okla.

[21] Appl. No.: 804,953

[22] Filed: Dec. 5, 1985

[51] Int. Cl.[4] ..... B05B 7/06

[52] U.S. Cl. ..... 239/427; 239/430; 239/553.5

[58] Field of Search ..... 239/427, 429, 430, 432, 239/553.5

[56] References Cited

U.S. PATENT DOCUMENTS

| | | | |
|---|---|---|---|
| 1,382,655 | 6/1921 | Kreitzer | 239/430 |
| 1,474,900 | 11/1923 | Goldsmith | 239/427 |
| 2,149,115 | 2/1939 | De Foe et al. | 239/430 |
| 3,421,693 | 1/1969 | Fraser | 239/15 |
| 3,628,734 | 12/1971 | Lindell | 239/403 |
| 3,650,476 | 3/1972 | Rackley et al. | 239/432 |
| 3,727,623 | 4/1973 | Robbins | 251/61.1 |
| 3,923,465 | 12/1975 | Krejci | 23/259.5 |

*Primary Examiner*—Carroll B. Dority, Jr.
*Attorney, Agent, or Firm*—John R. Casperson

[57] ABSTRACT

An atomizing nozzle for atomizing an oil stream with air is disclosed in which a plurality of oil streams are directed outwardly from an oil stream into a generally annularly shaped gas stream to form a mixture of oil and gas, a plurality of separate streams of said mixture of oil and gas are then directed inwardly for impingement with one another to form an atomizate, and the atomizate is directed outwardly in a plurality of separate streams from the nozzle.

18 Claims, 3 Drawing Figures

ATOMIZING NOZZLE AND USE

BACKGROUND OF THE INVENTION

In one aspect, the invention relates to a mixer for use in an atomizing nozzle. In another aspect, the invention relates to an atomizing nozzle. In yet another aspect, the invention relates to atomizing the oil feed to a furnace, such as for the production of carbon black, with an atomizing nozzle.

Good dispersion of the oil feedstock is required when the production of carbon black is desired from an oil furnace. Usually, the oil feedstock is a heavy oil or oil residium, since such feedstocks are plentiful, cheap, and have a high carbon content.

Atomization of heavy oil feedstocks, however, to achieve dispersion is difficult. The heat input required to vaporize many such feedstocks is sufficient in many instances to cause pyrolysis of the feedstock and coke deposition in an undesirable manner. Where the feedstock is not broken up into sufficiently small particles, it can penetrate from its release point to the reactor wall and form deposits which, as they slough off, cause grit contamination in the final carbon black product. Available atomizing bifluid nozzles for disintegrating the oil feedstock do not in all instances break the oil up into a sufficiently fine atomizate to prevent grit unless high volumes of atomizing fluid are passed through the nozzle together with the oil feed. This technique results in other changes in the properties of the carbon black product, such as a change in the structure as measured by DBP.

A nozzle for efficiently atomizing a heavy oil feed with low consumption of atomizing fluid would clearly be very desirable for use in a carbon black reactor.

OBJECTS OF THE INVENTION

It is a first object of the invention to decrease drastically the grit content in the carbon black product, especially in a soft black production process.

It is a further object of this invention to decrease drastically the atomizing fluid rate required for a given oil rate without sacrificing the degree of atomization.

It is a further object of the invention to provide a method for atomizing oil.

It is yet another object of this invention to provide a mixing body for a bifluid nozzle, a bifluid nozzle, and a carbon black reactor containing the bifluid nozzle for the production of carbon black.

SUMMARY OF THE INVENTION

In a first embodiment of the invention, there is provided a mixing body suitable for use in a bifluid nozzle. The mixing body has a generally cylindrical outer surface, a first end, and a second end. A first borehole extends from the first end of the mixing body towards the second end, and a second borehole extends from the second end of the mixing body toward the first end. However, the boreholes do not communicate. Instead, a first plurality of passages extends from the first borehole to open onto the generally cylindrical outer surface at a first longitudinal position on the generally cylindrical outer surface of the mixing body. A second plurality of passages extend from the second borehole and open onto the generally cylindrical outer surface of the mixing body at a second longitudinal position on the generally cylindrical outer surface of the mixing body. The second longitudinal position is between the first longitudinal position and the second end of the mixing body. An oil feed flowing into the first borehole can flow outwardly through the first plurality of passages where it can be mixed with an annular flow of atomizing fluid and the resulting mixture can then flow through the second plurality of passages and into the second borehole. Where a spray head covers the second borehole the atomizate can exit apertures in the spray head in the form of finally divided droplets, with low consumption of atomizing fluid. When the nozzle is employed in the carbon black reactor, an additional benefit is the production of a low grit content carbon black product.

In another aspect of the invention, there is provided a method for forming an atomizate with a nozzle. A plurality of oil streams are directed outwardly from a central oil stream to a generally annularly shaped gas stream to form a mixture of oil and gas. The mixture is then directed inwardly as a plurality of separate streams for impingement with one another to form an atomizate. The atomizate is subsequently directed outwardly from the nozzle, preferably as a plurality of separate streams. The method can be practiced with the apparatus previously described and is characterized with low consumption of atomizing gas and good dispersion of the atomizate. When the method is used in conjunction with the process for forming carbon black the carbon black product can contain an exceptionally low grit content.

DETAILED DESCRIPTION OF THE INVENTION

Figure 2:
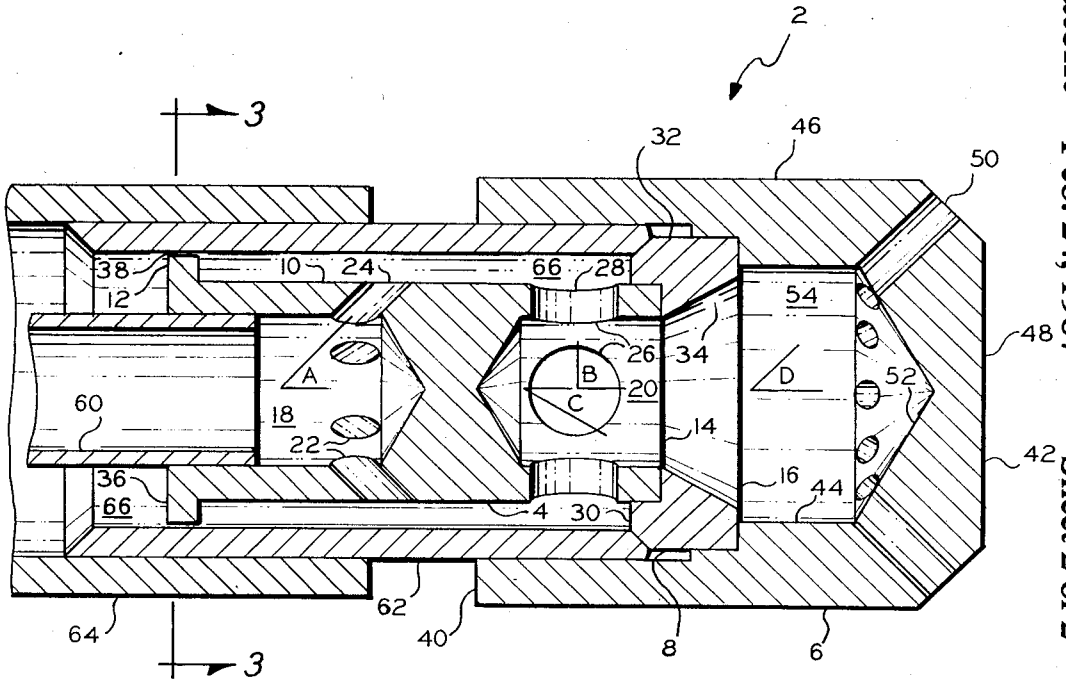
FIG. 2 is a longitudinal cross-sectional view of a portion of the apparatus shown in FIG. 1.
Figure 3:
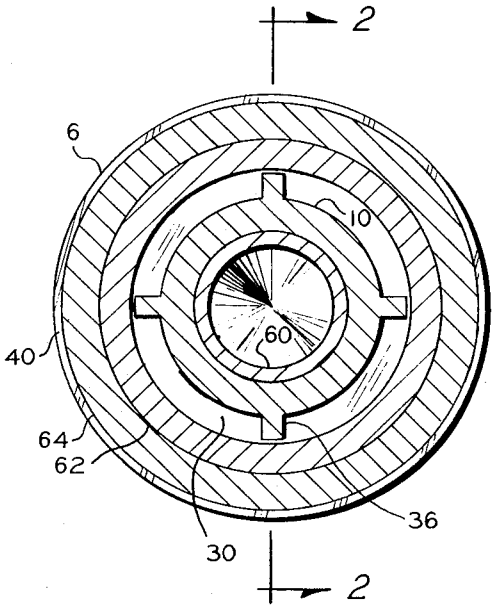
FIG. 3 is a cross-sectional view of the portion of the device shown in FIG. 2 when viewed along the indicated lines 3—3.

With reference to FIG. 2, a nozzle 2 comprises a mixing body 4 and a spray head 6. The nozzle 2 also comprises an extension 8 between the mixing body 4 and the spray head 6. The extension 8 can be separate from the mixing body 4 or the spray head 6 or it can be integral with either the mixing body 4 or the spray head 6. Preferably, the extension 8 is an integral part of the mixing body 4 because an extension 8 constructed integrally with the mixing body 4 has been tested with good results.

The mixing body 4, which is capable of separate manufacture and sale, will now be described. The mixing body 4 has a generally cylindrical outer surface 10, a first end 12, and a second end 14 or 16, depending on whether the extension 8 is present. For the purposes of explanation, the reference numeral 14 will be taken to correspond to the second end of mixing body while the reference numeral 16 will be taken to correspond to a second end of the extensIon 8. A fIrst borehole 18 extends from the first end 12 toward the second end 14 and a second borehole 20 extends from the second end 14 toward the first end 12 of the mixing body. The first borehole 18 and the second borehole 20, however, are not in direct communication and the passage is not present completely through the mixing body along its longitudinal axis. A first plurality of passages 22 extend from the first borehole 18 and open onto the generally cylindrical outer surface 10 at a first longitudinal position 24 on the generally cylindrical outer surface of the mixing body 4. A second plurality of passages 26 extend from the second borehole 20 and open onto the generally cylindrical outer surface 10 at a second longitudinal position 28 on the generally cylindrical outer surface of the mixing body 4. The second longitudinal position 28 is between the first longitudinal position 24 and the second end 14 of the mixing body.

Generally speaking, each of the first passages 24 will be drilled into the mixing body at an angle A generally between about 90° and about 30° as measured between a longitudinal axis of the passage 22 and a longitudinal axis of the mixing body with respect to the second end 14 of the mixing body 4. Usually, the angle A will be between about 90° and about 45°. Each passage of the second plurality of passages is generally drilled at an angle B as measured between a longitudinal axis of the passage 26 and the longitudinal axis of the mixing body 4 with respect to ihe second end 14 which is generally between about 90° and 135° and is usually about equal to about 90°. The number passages 22 and 26 should be sufficient to achieve the desired degree of atomization. Generally speaking, from about 4 to about 16 first passages 22 will be used. The number of second passages 26 in the mixing body 4 will generally be from about 4 to about 8. In the embodiment of the invention shown in the figure, the mixing body has been provided with six passages 22 and four passages 26, the diameter of the passages 26 being greater than the diameter of the passages 22.

The mixing body shown in FIG. 2 has a length between the first end 12 and the second end 14 which is preferably in the range of from about 2 to about 5 times the diameter of the mixing body across the generally cylindrical surface 10. The distance separating the first longitudinal position 24 from the second longitudinal position 28 is preferably in the range from about 0.3 to about three times the diameter of mixing body across the generally cylindrical surface 10.

Preferably, the extension 8 is positioned on the second end 14 of the mixing body 4. The extension 8 has a first end 30, the second end 16 and a generally cylindrical outer surface 32. The extension 8 is mounted by a portion thereof adjacent the first end 30 to the second end 14 of the mixing body 4. A passage extends through the extension 8 generally along a longitudinal axis of the extension 8. The passage acts as an extension of the borehole 20 and is defined by a generally frustoconical sidewall 34 diverging in a direction away from the second borehole 20 to the second end 16 of the extension 8. The frustoconical surface 34 defining the passage through the extension diverges at an angle C from the longitudinal axis of the extension which generally ranges from about 20 to about 70 degrees with respect to the second end 16 of the extension. It is important that the passage diverge to provide good atomization.

To assist in centering the mixing body in surrounding structure, preferably from 3 to 12 support legs 36 are mounted on the generally cylindrical outer surface of the mixing body and extend generally radially outward from it at a third longitudinal position 38 on the generally cylindrical outer surface 10 of the mixing body which is preferably adjacent to the first end 12 of the mixing body 4.

The spray head 6 has a first end 40 and a second end 42 which corresponds to the second end of the nozzle. The spray head 6 has a generally cylindrical inner surface 44 and, for convenience in fabrication, a generally cylindrical outer surface 46. The spray head 6 is generally symmetric about a longitudinal axis thereof. An end closure portion 48 of the spray head partially closes an inside of the head from an outside. The end closure portion has a plurality of ports 50 through it which open onto the second end 42 of the spray head along a circle around the longitudinal axis of the spray head. Preferably, the generally cylindrical inner surface 44 of the spray head 6 is connected to the second end 16 of the extension 8 so that the longitudinal axis of the spray head 6 coincides with the longitudinal axis of the mixing body 4 and of the extension 8. The end closure portion 48 of the spray head 6 has an inner surface 52 which is spaced apart from the second end 16 of the extension 8 so that an atomization chamber 54 is formed defined in part by the inner surfaces 52, 44, and 34.

Figure 1:
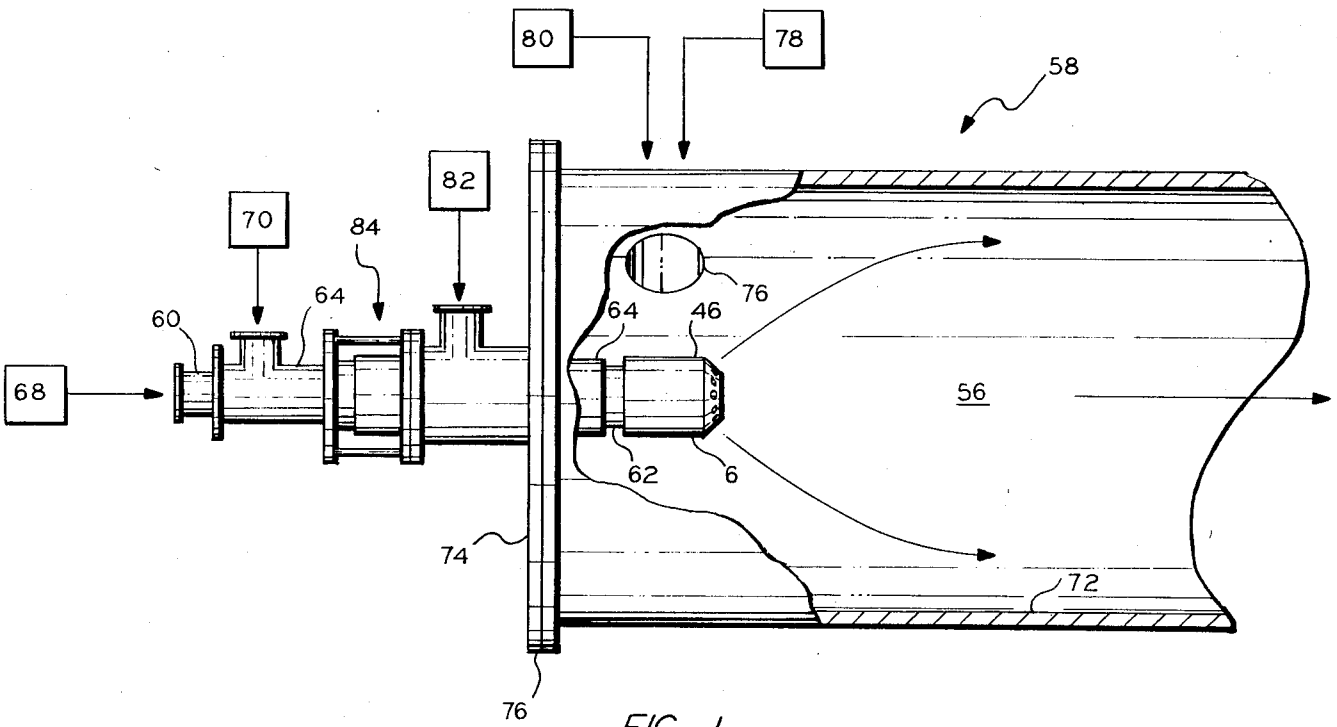
FIG. 1 illustrates a process for the production of carbon black embodying certain features of the present invention.

Preferably, the passages 50 establish a flow path between the chamber 54 and a combustion zone 56 of a carbon black reactor generally designated by 58 in FIG. 1. Each of the plurality of passages or ports 50 extends through the end closure 42 on the spray head 6 and usually forms an angle D from about 5° to about 75° as measured between the longitudinal axis of the port 50 and the longitudinal axis of the spray head 6 with respect to the second end 42 of the spray head 6. Preferably the angle D will be between about 10° and about 60°. Usually, the plurality of passages 50 will be formed from about 8 to about 32 passages. Preferably between about 12 and 24 passages 50 will be provided in the spray head 6.

When installed in a furnace such as the carbon black reactor 58, the apparatus of the invention will usually further comprise a first tubular member 60 connected to the first borehole 18 in the mixing body 4 and a second tubular member 62 connected to the first end 40 of the spray head 6. In the illustrated embodiment, the second tubular member 62 is formed from a fitting welded to the end of a pipe 64 which carries the atomizing gas to the nozzle 2. The tubular member 62 is concentrically positioned with respect to the tubular member 60 and the mixing body 4 so that an annular chamber 66 is formed between the first tubular member 60 and the second tubular member 62 and the mixing body 4 and the second tubular member 62. The mixing body 4 is positioned at least partially inside of the second tubular member 62 and is mounted on the end of the first tubular member 60. The inside diameter of the second tubular member 62 generally ranges from about 1.1 to about 2 times the outside diameter of the mixing body 4.

Referring now to FIG. 1, the first tubular member 60 is connected to a source 68 of oil. The second tubular member 62 is connected to a source of atomizing gas 70 via the tubular member 64. The source 68 of oil feedstock will generally be some form of heavy oil such as a residuum, an extract oil or a coal tar. It is desirably highly aromatic in character for the production of high quality carbon black at good yields. The source 70 of atomizing gas is conveniently air although steam of other light gas such as nitrogen or methane is also suitable. Fluid flow from the sources 68 and 70 can be regulated as is known in the art.

When the invention is to be used for the production of carbon black, the apparatus will generally further comprise a third tubular member 72 which is generally concentrically positioned with respect to the longitudinal axis of the spray head 6 and is spaced apart from the outer surface 46 of the spray head at a distance. An end closure 74 closes a first end 76 of the tubular member 72. Generally, both the members 72 and 74 are formed from refractory material and are heavily insulated and together they define the chamber 56. Conventional cooling and collecting equipment (not shown) is located at the downstream end of the chamber 56. The end closure 74 has a passage through it generally along the longitudinal axis of the tubular member 72 and the second tubular member 64 extends through the passage in the end closure 74. In this manner, the sprayhead 6 is positioned along the longitudinal axis of the tubular member 72 with the ports 50 through the end closure 48 of the spray head pointing away from the end closure 74 on the third tubular member 72. At least one tunnel 76 is preierably provided opening into the chamber 56 at a position near the end closure 74. A source 78 of oxygen-containing gas is connected to the tunnel 76. A source 80 of combustible fluid, such as oil or natural gas or recycled reactor off gas is optionally connected to the tunnel 76 when it is desired to introduce combustion gases rather than hot air into the chamber 56 for pyrolysis of the oil feed from source 68. A source 82 of cool gas such as air is positioned to empty into the chamber 56 through an annulus between the pipe 64 and the end closure 74. The flow of cool gas is small, but is desirable to protect the nozzle 2. Sealing means 84 is preferably provided to slidably mount the pipe 64 through the end closure 74 and seal the chamber 56 from its environment.

In one aspect of the invention, there is provided a method for forming atomizate with a nozzle. A plurality of oil streams are directed outwardly such as through passages 22 from an oil stream into a generally annularly shaped gas stream to form a mixture of oil and gas. The mixture is then divided into a plurality of separate streams, such as the streams flowing through passages 26 and directed inwardly for impingement with one another to form an atomizate. The atomizate is then directed outwardly such as through the ports 50 in a plurality of separate streams from the nozzle 2. Preferably, the mixture flows through a generally annularly shaped mixing chamber, such as the chamber 66, in the nozzle. The atomizate preferably flows through a diverging path prior to flowing into an atomizing chamber, such as the chamber defined by the sidewall 34 and is then directed outwardly in the plurality of separate streams from the nozzle.

Where the invention is to be used for carbon black production, the gas stream from source 70 will usually comprise air or steam, preferably air for convenience, and the oil stream will have been preheated, such as to a temperature of from about 100° to 400° C., generally from 150° to 350° C., to assist in vaporization. As compared to a prior art nozzle, consumption of atomizing gas in the inventive nozzle is reduced approximately 50%. For example, it is expected that from about 15 to about 25 kg of oil can be atomized with each normal cubic meter ($Nm^3$) of air. The prior art nozzle could only accomplish the atomization of 10 kg of oil with each normal cubic meter of air.

The invention has special applicability for the production of "soft"carbon blacks, such as those having surface area in the range of from 20 $m^2$ per gram up to about 75 $m^2$ per gram. In processes for the production of "soft"black, low combustion gas velocities in the reactor sometimes previously allowed penetration of the feedstock from the axial spray head to the reactor wall, resulting in the production of grit in the carbon black product. The prior art nozzle required a high atomizing air rate in order to sufficiently disintegrate the feedstock and prevent excessive amounts of it from reaching the reactor wall. However, the high air rates caused an undesirable change in the structure of the carbon black product as measured by the DBP test. Too low of an atomizing air rate caused grit production while too high of an air rate caused off-specification structure in the product. The present invention avoids these problems by operating efficiently with a much smaller amount of air for atomization.

The invention is illustrated by the following example.

EXAMPLE I

Low grit N-550 carbon black was produced in a standard tangential reactor with a 24 inch ID zone 56 23 inches long followed by a 28 inch ID zone. Two tangential tunnels 76 were present each having a 6 inch inside diameter.

The spray head 6 was formed from 316 stainless steel and had sixteen 0.177 inch ports 50. The angle D was 20°. The inside diameter of chamber 54 was 1.575 inches. The overall length of the spray head was 2.36 inches. The mixing body 4 and extension 8 were integral and formed from 316 stainless steel. The first borehole 18 had an inside diameter of 0.803 inches. The second borehole 20 had an inside diameter of 0.90 inches. Ten ports 22 each having a diameter of 0.1875 inches connected the first borehole 18 with the chamber 66. The angle A was 45°. Four 0.375 inch passages 26 connected the chamber 66 with the borehole 20. The angle B was 90°. The angle C was 45° and the length of the frustoconical section was 0.175 inches. Approximately 1.60 inches separated the first position from the second position.

Table 1 sets forth operation of the device.

TABLE I

| | Run No. | | | | | |
|---|---|---|---|---|---|---|
| | 1 | 2 | 3 | 4 | 5 | 6 |
| Air | | | | | | |
| Tangential (SCFH) | 114,731 | 115,916 | 115,339 | 113,766 | 128,004 | 121,622 |
| Axial (SCFH) | 10,948 | 10,910 | 10,898 | 10,837 | 10,617 | 10,627 |
| Atomizing (SCFH) | 6,459 | 6,371 | 6,410 | 6,408 | 4,914 | 3,858 |
| Total (SCFH) | 132,138 | 133,197 | 132,647 | 131,011 | 143,535 | 136,107 |
| Conversion Oil[3] | | | | | | |
| Rate (GPM) | 330 | 334 | 336 | 322 | 346 | 332 |
| Nozzle Pres. (PSIG) | 51 | 51 | 50 | 51 | 47 | 45 |
| Nozzle Spray Angle | 40 | 40 | 40 | 40 | 40 | 40 |
| Nozzle Position (inch)[1] | Flush | Flush | +6 | +6 | +6 | +6 |
| Fuel Gas (SCFH) | 0 | 0 | 0 | 0 | 0 | 0 |
| Temperature (°F.) | | | | | | |
| Air - in/out | 175/851 | 176/848 | 177/849 | 179/834 | 183/820 | 170/822 |
| Oil | 330 | 336 | 336 | 336 | 347 | 331 |

TABLE I-continued

| | Run No. | | | | | |
|---|---|---|---|---|---|---|
| | 1 | 2 | 3 | 4 | 5 | 6 |
| Air/Oil Ratio | 400 | 399 | 395 | 407 | 415 | 410 |
| I2/CTAB | 42/- | 45/- | 41/- | 43/40.6 | 40/- | 43/- |
| Average Grit (325 Mesh)[2] | 0.0030 | 0.0061 | 0.0082 | 0.0094 | 0.0056 | 0.0081 |

Notes:
[1]Measurement taken from the refractory firewall to the oil nozzle tip.
[2]Samples taken from the dryer.
[3]Oil

| | |
|---|---|
| API Grav. | −2.30 |
| % Carbon | 90.15 |
| % Hydrogen | 7.51 |
| % Sulfur | 2.33 |

It is seen that the carbon black product is characterized by exceptionally low grit values.

EXAMPLE II

The nozzle of the invention is compared to a prior art nozzle in Table II as follows.

TABLE II

| | Oil Rate kg/h | *Minimum atomizing air rate $Nm^3/h$ | Oil vs at. air Maximum Ratio $kg/Nm^3$ |
|---|---|---|---|
| STD | 1,800 | 180 | 10 |
| PEABODY | 2,100 | 210 | 10 |
| BURNER | 1,500 | 140 | 10.7 |
| NEW | 2,600 | 140 | 18.6 |
| BURNER | 3,000 | 150 | 20 |
| | 3,400 | 170 | 20 |

*Minimum: if you use less atomizing air, grits level becomes out of specifications. Carbon black structure level gives you the maximum air rate usable.

It is seen that the new burner is much more efficient in air usage.

That which is claimed is:

1. Apparatus comprising:

a mixing body having a generally cylindrical outer surface, a first end, a second end, a first borehole extending from the first end toward the second end, a second borehole extending from the second end toward the first end, said first borehold and said second borehole not being in direct communication, a first plurality of passages extending from the first borehole opening onto the generally cylindrical outer surface at a first longitudinal position on the generally cylindrical outer surface of the mixing body; and a second plurality of passages extending from the second borehole opening onto the generally cylindrical outer surface at a second longitudinal position on the generally cylindrical outer surface of the mixing body between the first longitudinal position and the second end of the mixing body; and an extension mounted on the second end of the mixing body, said extension having a first end, a second end, and a generally cylindrical outer surface, the extension being mounted by a portion adjacent the first end thereof to the second end of the mixing body, said extension having a passage therethrough extending along a longitudinal axis thereof, said passage having a generally frustoconical sidewall diverging in a direction away from the second borehole to the second end of the extension.

2. Apparatus as in claim 1 wherein each passage of the first plurality is drilled at an angle A of between about 90° and about 30° as measured between a longitudinal axis of the passage and a longitudinal axis of the mixing body with respect to the second end of the mixing body.

3. Apparatus as in claim 2 wherein each passage of the second plurality of passages is drilled at an angle B as measured between a longitudinal axis of the passage and the longitudinal axis of the mixing body which is about 90°.

4. Apparatus as in claim 3 wherein the first plurality of passages is from about 4 to about 16 and the angle A is from about 90° to about 45° and wherein the plurality of second passages is from about 4 to about 8.

5. Apparatus as in claim 4 wherein the mixing body is characterized by a first diameter across the generally cylindrical outer surface, a length between the first end and the second end which is in the range of from 2 to 5 times the first diameter, and wherein a distance in the range of from about 0.3 to about 3 times the first diameter separates the first longitudinal position from the second longitudinal position.

6. Apparatus as in claim 3 wherein the sidewall of the generally frustoconical diverging portion of the passage through the extension diverges at an angle C of from about 20° to about 70° from the longitudinal axis of the extension with respect to the second end of the extension.

7. Apparatus as in claim 3 further comprising from 3 to 12 support legs mounted to the generally cylindrical outer surface of the mixing body and extending generally radially outwardly therefrom at a third longitudinal position on the generally cylindrical outer surface of the mixing body adjacent to the first end of the mixing body.

8. Apparatus as in claim 3 further comprising a spray head having a first end and a second end, a generally cylindrical inner surface and an outer surface, a longitudinal axis, and an end closure partially closing the second end of the spray head, said end closure having a plurality of ports therethrough opening onto the second end of the spray head along a circle around the longitudinal axis of the spray head, the generally cylindrical inner surface of the spray head being connected to the second end of the extension to the mixing body so that the longitudinal axis of the spray head coincides with the longitudinal axis of the mixing body, the end closure of the spray head having an inner surface which is spaced apart from the second end of the extension to the mixing body so that a chamber is formed.

9. Apparatus as in claim 8 wherein each of the plurality of ports through the end closure on the spray head forms an angle D of from about 5° to about 75° as measured between the longitudinal axis of the spray head and the longitudinal axis of the port with respect to the second end of the spray head.

10. Apparatus as in claim 9 wherein the number of ports through the end closure on the spray head is from about 8 to about 32.

11. Apparatus as in claim 9 wherein the number of ports through the end closure on the spray head is from about 12 to about 24.

12. Apparatus as in claim 8 further comprising a first tubular member axially connected to the first borehole in the mixing body and a second tubular member axially connected to the first end of the spray head, said second tubular member being concentrically positioned with respect to the first tubular member so that an annular chamber is formed between the first tubular member and the second tubular member, the mixing body being positioned at least partially within the second tubular member and mounted on the end of the first tubular member.

13. Apparatus as in claim 12 further comprising a source of oil connected to the first tubular member and a source of atomizing member. connected to the second tubular member.

14. Apparatus as in claim 13 further comprising a third tubular member formed from a refractory material generally concentrically positioned with respect to the longitudinal axis of the spray head and spaced apart from the outer surface of the spray head a distance, an end closure closing an end of the third tubular member, said end closure being formed from a refractory material and having a passage therethrough along the longitudinal axis of third tubular member with the second tubular member being positioned in said passage so that the spray head is positioned inside of the third tubular member along the longitudinal axis of the third tubular member with the ports through the end closure of the spray head pointed away from the end closure on the third tubular member; a tunnel opening into the third tubular member near the end closure; and a source of oxygen-containing gas connected to the tunnel.

15. A method for forming atomizate with a nozzle, said method comprising directing a plurality of oil streams outwardly from an oil stream into a generally annularly shaped gas stream forming a mixture of oil and gas;

directing a plurality of separate streams of said mixture of oil and gas inwardly for impingement with one another to form an atomizate; and directing the atomizate outwardly in a plurality of separate streams from the nozzle.

16. A method as in claim 15 further comprising flowing the mixture through a generally annularly shaped mixing chamber in the nozzle; and flowing the atomizate through a diverging passage and into an atomizing chamber in the nozzle prior to directing the atomizate outwardly in a plurality of separate streams from the nozzle.

17. A method as in claim 16 wherein the gas stream comprises air and the oil stream has been heated.

18. A method as in claim 17 wherein the atomizate is formed with from in the range of 15 to 25 kg of oil residuum or extract for each $Nm^3$ of air.

* * * * *